US005695298A

United States Patent [19]

Sandström

[11] Patent Number: 5,695,298

[45] Date of Patent: Dec. 9, 1997

[54] CONTROL OF A COMPACTING MACHINE

[75] Inventor: Åke Sandström, Sollentuna, Sweden

[73] Assignee: Geodynamik H. Thurner AB, Stockholm, Sweden

[21] Appl. No.: 522,259

[22] PCT Filed: Mar. 8, 1994

[86] PCT No.: PCT/SE94/00195

§ 371 Date: Sep. 8, 1995

§ 102(e) Date: Sep. 8, 1995

[87] PCT Pub. No.: WO94/20684

PCT Pub. Date: Sep. 15, 1994

[30] Foreign Application Priority Data

Mar. 8, 1993 [SE] Sweden ..... 9300776

[51] Int. Cl.[6] ..... E01C 19/28

[52] U.S. Cl. ..... 404/72; 404/84.05; 404/117; 404/133.05

[58] Field of Search ..... 404/72, 117, 130, 404/133.05, 75; 73/573, 579; 318/607, 608

[56] References Cited

U.S. PATENT DOCUMENTS

| | | | |
|---|---|---|---|
| Re. 31,195 | 4/1983 | Thurner | 73/573 |
| 4,103,554 | 8/1978 | Thurner | 404/133.05 X |
| 4,330,738 | 5/1982 | Paramythioti et al. | 318/608 X |
| 4,467,652 | 8/1984 | Sandstrom | 73/573 |
| 4,546,425 | 10/1985 | Breitholtz | 404/117 X |
| 4,734,846 | 3/1988 | Konig | 73/573 X |
| 4,870,601 | 9/1989 | Sandstrom | 404/117 X |
| 5,177,415 | 1/1993 | Quibel et al. | 73/573 X |

*Primary Examiner*—James Lisehora

*Attorney, Agent, or Firm*—Birch, Stewart, Kolasch & Birch, LLP

[57] ABSTRACT

A roller machine for compacting is provided with control devices for varying the oscillation movement of the body. The movement of the body may be affected by a weight attached thereto. The oscillation of the vibration body is measured. From this measurement, the portion of the oscillation is determined having a frequency corresponding to half the excitation frequency and the portion for other oscillation, in particular the excitation frequency, are also determined. The excitation of the vibrating body is controlled so that the harmonic component having half the excitation frequency will be in a predetermined proportion of the component of the oscillation component. Such control avoids undesired oscillation movement.

19 Claims, 4 Drawing Sheets

Acce-
lerom.
7
Pulse
sensor
33
Prefilter
having a broad
pass-band
11
Band-pass fil-
ter for half
the excitation
frequency
15
19
Low-pass
filter
23
Band-pass
filter for the
excitation
frequency
13
17
Low-pass
filter
21
Division
circuit
÷
25
27
29
PLL
$f_e$
$n \cdot f_e$
Divide
by
z
31

CONTROL OF A COMPACTING MACHINE

FIELD OF THE INVENTION

The present invention is related to control of a vibrating compacting roller and similar devices for compacting or compressing a more or less dense material such as ground surfaces of the types earth or soil, road embankments, asphalt, etc, the term "ground" meaning a surface to be compacted, located underneath the compactor.

BACKGROUND OF THE INVENTION AND PRIOR ART

In compacting a ground material it is naturally desirable to have it performed as rapidly and as efficiently as possible. For a vibrating roller machine or another vibrating body contacting the ground different parameters may be varied for this purpose, in many cases most simply in the excitation imparting the vibrating movement to the roller. It is thus possible e.g. to increase the amplitude of the vibration by means of different devices coupled to an eccentrically arranged weight which in the common way produces the vibrating movement. Such a loaded and vibrating roller of a compacting roller machine can, in a hard operation with a large vibratory movement, enter undesired oscillating states such as double jumps (the roller is in contact with the ground only at every other stroke of the eccentric mass) and cradle oscillation (the axis of the roller is swung about swinging axis perpendicular to the roller axis, so that a hard blow or jolt is obtained in the area at one end of the roller only at every other stroke of the exciting, eccentrically arranged weight, and in the other strokes a hard blow or jolt is obtained in the area at the other end of the roller). In these undesired oscillating states even a disintegration of the ground material may take place.

There is thus a need of methods and devices for allowing the operation of e.g. a roller machine with an oscillating movement which is as large as possible, avoiding that the roller enters the undesired oscillating states mentioned above.

From the Swedish patent 8202103-1 for Dynapac Maskin AB (corresponds to U.S. Pat. No. 4,546,425 and DE-A1 33 08 436) it is previously known to control a vibrating roller machine so that the amplitude of the vibratory oscillations of the roller machine is increased continuously with a predetermined velocity, as long as the vibration movement of the roller machine is regular or as long as the irregularity of the vibration movement does not exceed selected amplitude values. In this patent it is not described, however, how the irregularity can be or is to be measured and evaluated. Signal sensors mounted to the roller or the frame of the roller generate signals and the difference of these signals or the deviation of these signals from a harmonic oscillating shape is fed to an amplitude adjusting device of an eccentric element exciting the vibratory movement of the roller drum. The continuous, smooth increase of the amplitude is interrupted when this difference or this deviation achieves some predetermined values. Then the exciting effect of the eccentric element is reduced so that the amplitude of the vibratory movement will continuously decrease somewhat, with a predetermined smooth velocity during a given time period, after which the excitation degree is increased again, so that the amplitude of the vibrating oscillations of the roller drum again will increase continuously, after which the procedure is repeated. In this patent it is not mentioned, as has already been indicated, anything on the matter how the regularity or the irregularity of the vibration movement of the roller can be measured or estimated.

Other methods for the control of a vibrating roller machine appear from U.S. Pat. Nos. 3,797,954 and 4,330,738, DE patent document 25 54 013 and GB patent document 1,372,567. The measurement of the amplitude of the vibrating movement and the compaction degree achieved are treated in U.S. Pat. No. 4,103,554 and the international patent application having publication number WO 82/01905.

DESCRIPTION OF THE INVENTION

It is a purpose of the invention to provide a method and a device for the control of a vibrating roller machine or another vibrating device for compacting and compressing a base or ground material such as earth or soil, by means of which the compaction of the material is performed with an efficient use of controllable oscillating movement of a vibrating compaction body.

It is another purpose of the invention to provide a method and a device for the control of a vibrating roller machine or similar device so that the excitation of the roller, in the compaction of the ground material, is made as strong as possible.

These purposes are achieved by the invention, the more close features and characteristics of which appear from the appended claims.

A roller machine or another device for compacting earth, soil or similar materials is provided with control devices for variation of the oscillating movement of the roller or the compacting body, this movement being excited by an eccentric body. The oscillation of the vibrating roller or the compacting body is measured and therefrom the oscillation portions are determined having a frequency corresponding to half the excitation frequency, and for other oscillation modes and particularly corresponding to the excitation frequency. The excitation of the vibration of the roller or compacting body is controlled, so that the portion of the oscillation component having half the frequency will be a predetermined portion of the component of the other oscillation components or at least in such a way that this portion will be as close as possible the desired value in regard of the possible excitation, bearing stresses and similar factors.

The oscillating movement of the roller or compacting body can be controlled in various ways, both by varying the excitation, and by changing other parameters such as the rotation velocity of the roller in the rolling traversal movement thereof over the ground and the static load or force which the roller or the compacting body respectively imparts to the ground material. In the latter case the mass distribution of the roller machine can be changed by displacing static load masses, e.g. by pumping water between different containers. In a variation of the excitation an excitation body may be given a stroke length having a varying size, for a rotational excitation an eccentric body can be given an eccentricity of different sizes, the mass of the excitation mass or the mass of the eccentric body can be changed and the frequency and rotational velocity respectively of its vibrating movement can be changed. In a standard case with one single type of variable excitation arranged in the machine excitation means may be arranged which in the control of the excitation thereof are arranged to excite the compacting body so that its resulting oscillating movement for varying excitation degrees will have substantially varying amplitudes or substantially varying frequencies.

In the measurement of the oscillating movement of the roller advantageously a sensor can be used which can be mounted to a frame part such as a bearing plate in which the roller is rotatably mounted. The sensor can also be arranged directly on the compacting body. The sensor is then arranged to produce a signal which in some way represents the oscillatory movement of the roller or of the compacting body and in particular the oscillating movement in an approximately vertical direction. e.g. in a plane through the rotational axis of the roller deviating at most 30° from a vertical plane. The plane should further pass approximately symmetrically through the compacting body and for a roller thus through its rotational axis. Advantageously an accelerometer is used as a sensor, the output signal of which can be directly used as a measurement of the oscillating movement. Alternatively a sensor can be used directly generating signals representing the velocity or displacement of the roller or the compacting body. From an acceleration signals also such signals can be determined by an integrating operation in an integrator but it produces no more information.

In an analogue circuit for producing a signal representing the oscillation portion or component having half the frequency the signal from the sensor, which can possibly be first processed for filtering away too extreme frequencies, this filtering being performed by integration or similar methods, is fed to two band-pass filters having narrow pass-bands centered around center frequencies which advantageously are adjustable or controllable. The center frequencies are selected in such a way that one corresponds to half the frequency of the vibration frequency of the excitation of the roller and the other corresponds to this excitation frequency. Signals representing the amplitude of the components, which have been filtered out, are then produced by rectifying and low-pass filtering. The amplitude signals thus obtained are delivered to a division circuit which then produces the desired signal on its output terminal.

For control of the center frequencies of the band-pass filters a pulse signal having a suitably high frequency can be produced from the signal of the sensor, which signal is shaped into pulses and is fed to a phase-lock circuit containing a frequency division circuit. The pulse signal thus produced is then fed to one of the band-pass filters while the other band-pass filter receives the corresponding pulse signal which has passed through a circuit for extracting pulses having half the frequency imparted to the roller.

In a corresponding digital circuit the corresponding signal processing can be performed in a central logic unit or processor. The signal representing the oscillatory movement is converted in the common way, first by sampling in a converter to a digital shape to be fed to the processor. The sampling in the converter can be controlled concurrently with the periods of the oscillatory movement. Therefor, like the analogue case, pulses are generated, representing the frequency of the oscillating movement, directly from the sensor signal. In other cases a pulse sensor can be provided producing pulses representing the frequency of the excitation and also representing a definite phase position thereof. From this signal a signal is produced having pulses of a higher frequency, this frequency being a predetermined, e.g. an even, multiple of the excitation frequency. When these signals having higher frequencies are fed to the converter, it will during each oscillation period always produce the same number of sampled digital values. It facilitates the calculations in the processor. The signals having a higher frequency for the control of the sampling will then also have a certain, fixed phase position in relation to the periodic excitation.

The mentioned control of the sampling times of the converter can be used in the control of the vibratory movement of roller machines and other compacting devices, whenever an evaluation or processing of the oscillation movement is desired in a digital shape, in order to be able to influence the size and/or frequency of the vibrational movements and/or to adjust the excitation parameters. Generally, in such a control in some way the times are determined when each oscillation period stops. The time period between these times is divided into a predetermined number of equally long time periods or slots and the sampling is performed in each such slot such as at the beginning thereof. The start of each oscillation period can be determined from the times when the oscillation signal passes some predetermined level in a predetermined direction, possibly after some preshaping of the signal, e.g. when the signal passes the zero level. Alternatively information is obtained relating to the beginning of the oscillation period from some other signal, e.g. as obtained from a pulse sensor sensing the excitation. The control signals for the sampling will then like above be given a definite phase position in relation to the periodic excitation which can be valuable in the determination of control parameters.

BRIEF DESCRIPTION OF THE DRAWINGS

The invention will now be described as a not limiting embodiment with reference to the accompanying drawing in which.

DESCRIPTION OF THE PREFERRED EMBODIMENT

Figure 1:
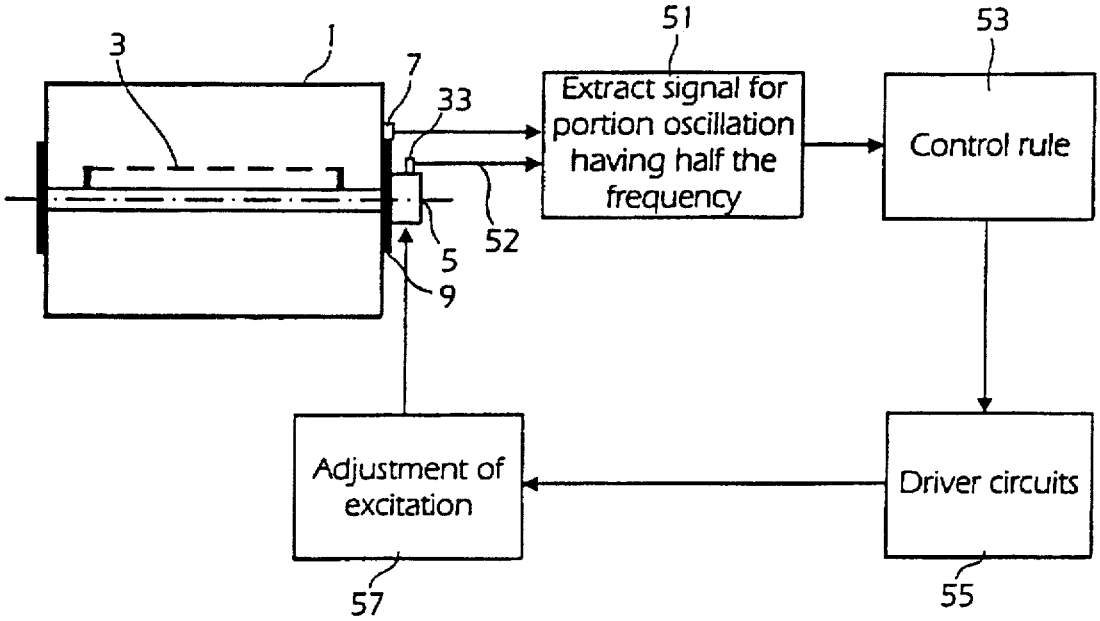
FIG. 1 is a block diagram of a control system of a roller machine.

In FIG. 1 the system is shown for control of a vibrating roller 1. The roller 1 is provided with a weight 3, which is arranged therein, is eccentrically located and rotatable and which rotates about the same rotational axis 5 as the roller 1. The rotating weight 3 excites the roller 1, so that it performs an oscillatory or vibrational movement. The excitation can further be varied by influencing the rotational velocity of the body 3 and/or the size of its mass or its eccentric position. The rotating weight can also, in the conventional way, be divided into two part masses placed close to the ends of the shaft 5, so that the exciting force can be transferred to the roller without subjecting the rotating shaft to an unnecessarily large bending moment.

Figure 4:
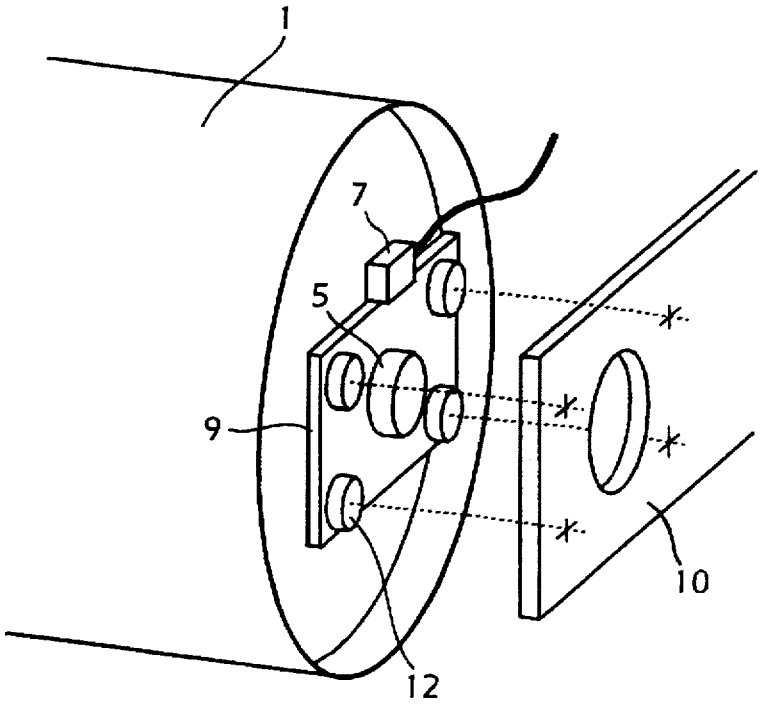

The vibratory movement of the roller is sensed by an accelerometer 7 placed on one of the frame parts such as a bearing plate 9, in which the roller 1 is rotatably mounted, see FIG. 4. The bearing plate 9 is further resiliently suspended with shock-absorption in the frame 10 of the roller machine by means of buffers 12. The accelerometer 7 is advantageously mounted substantially straight above the rotational axis of the roller 1. The signal from the accelerometer 7 is fed to signal processing circuits 51, in which an electric signal is produced representing the portion oscillating component having half the base frequency of the oscillation movement of the roller compared to the oscillation components of those frequencies which are equal to or higher than the base frequency, with which the oscillation movement is excited by the eccentric mass 3.

The circuits 51 can further in the signal processing also use a signal representing the rotational velocity or the frequency of the rotational movement of the eccentric mass 3, this signal being fed from a pulse sensor 33 to the circuits 51 on a wire 52.

The signal from the signal processing circuits 51 are processed by logic circuits 53 which according to a stored control rule and guided by the signal produced determine a suitable control signal so that the incoming signal which represents the oscillation portion having half the frequency will have a predetermined value. The logic circuits 53 must then consider the mechanical limitations of the machine such as a maximally allowed or possible amplitude of the oscillation movement of the roller, maximum bearing stresses, etc. The control rule can, for a simple case with only a variation of the amplitude of the oscillation movement, be such that the excitation by means of the eccentric rotating mass all the time produces an oscillation amplitude corresponding to the smaller amplitude value selected among the amplitude producing the desired oscillation portion having half the frequency and the amplitude with which the roller machine maximally can be operated.

From the logic circuits 53 signals are transferred to driver circuits 55, which when required activate actuating devices 57 for variation of the excitation of the eccentric weight 3 of the oscillation movement of the roller 1.

Figure 2:
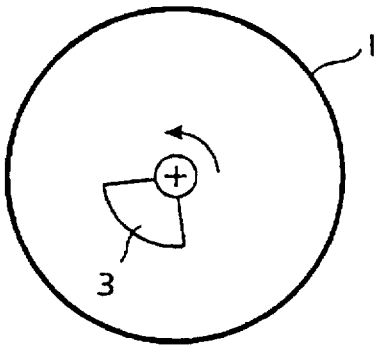
FIGS. 2–3 are schematic pictures from the side which illustrate different ways of producing an oscillation movement of an earth compacting roller, FIG. 4 schematically shows the mounting of a sensor on a bearing plate adjacent to a compacting roller.
Figure 3:
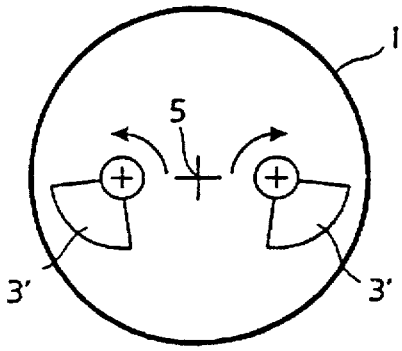

In FIGS. 2–3, schematically from the side, two different ways are illustrated for excitation of the vibrations of a rotating roller drum. In FIG. 2 there is, as is indicated in FIG. 1, an eccentrically located weight 3 which rotates about the same axis 5 as the roller drum but with a larger velocity than that of the roller. The rotational movement of the eccentric body 3 produces a force on the roller drum 1 which has a substantially constant size and which performs a rotational movement. In FIG. 3 two eccentric weights 3' are arranged which rotate about axes located in the same horizontal plane and at a distance from the rotational axis of the roller drum 1. When the eccentric weights 3' rotate in opposite directions of each other, forces are obtained affecting the roller drum 1 which will be directed substantially in the vertical direction when the relative positions of the eccentric weights 3' are such as indicated in the drawing.

In these methods of exciting the roller drum 1 the roller will, as has already been indicated, be subjected to a vibrating oscillating movement. The size of the oscillation can be influenced, by the method that the eccentric body/bodies 3 or 3' respectively e.g. is/are driven with larger or smaller rotational velocity, i.e. by varying the frequency of the excitation. By further changing the size of the mass of the eccentric body/bodies 3 and 3' the amplitude of the excitation can be varied. As a supplement of varying the mass/masses 3 or 3' or instead it is naturally also possible to change the distance of the mass/masses from its/their rotational axis/axes. It can e.g. be accomplished by the method that the eccentric body or the eccentric bodies each one is divided into two part masses which can be adjusted in varying angles in relation to each other and that a first part mass is rigidly attached to the shaft and that a second part mass can be adjustably turned about the shaft in relation to the first part mass. The common point of inertia of the two part masses can in that way be located at different distances of their rotational axes.

When the eccentric body rotates, thus a vibration or oscillating movement of the roller drum is obtained. This vibration is, when the roller drum 1 is placed on ordinary grounds, not harmonic and therefore no definite amplitude can be established for the oscillation movement. Instead, as an amplitude of the oscillation movement of the roller for a given excitation, i.e. with definite excitation conditions resulting from the geometry and the mass of the eccentric body, a nominal amplitude can be determined which is the amplitude of the roller vibration or the roller oscillation when the roller is allowed to oscillate freely. More particularly, the nominal amplitude can be defined as the quotient of the torsional moment of the eccentric body or bodies and the whole mass of the roller. It is independent of the excitation frequency.

The oscillation movement of the roller cylinder 1 can, as been indicated above, be registered or recorded by means of a suitable sensor, which can be located on a frame part 9 cushioned in the principal frame 10 of the roller machine, in which the roller drum 1 is rotationally mounted, see FIG. 4. The sensor 7 can be designed to measure the acceleration, the oscillation velocity or the displacement but preferably here, in the conventional way, an accelerometer is used. This sensor is then arranged to sense movements which are performed or takes place substantially in the vertical direction or generally in some small angle, e.g. smaller than 30°, in relation to a vertical plane.

Figure 5:
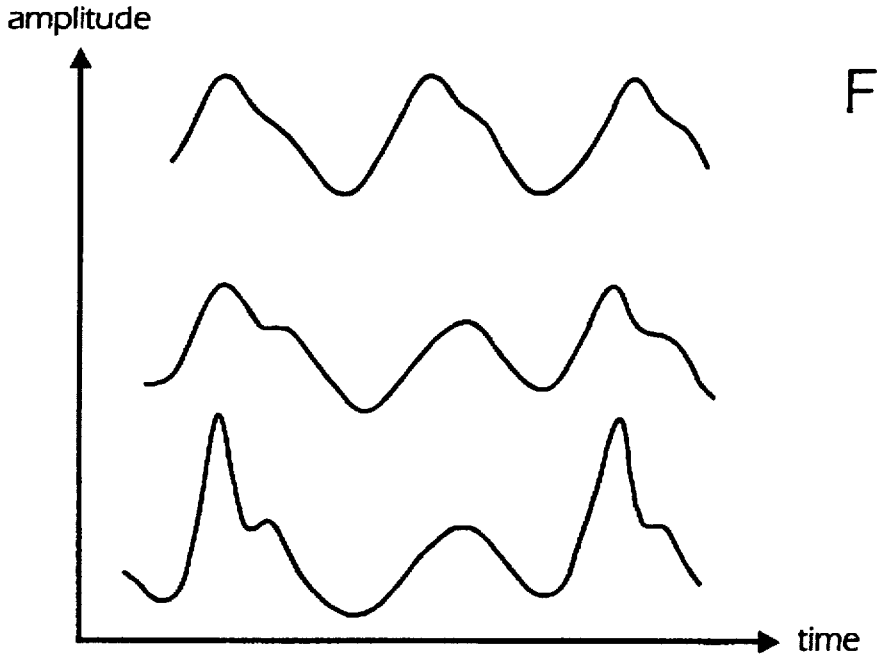
FIG. 5 shows signals determined by an accelerometer for different roller excitations.

In FIG. 5 signals are illustrated which have been registered by an accelerometer for a vibrating roller and for various excitations of the oscillation of the roller. The top curve shows a case having a relatively low excitation or with a soft ground. The oscillation is not harmonic or sinus shaped but shows overtones due to the asymmetry of the forces influencing the roller. Among other facts the ground can not exert any significant tensile forces but instead more or less elastically receive compressive forces.

For an increasing excitation or with a stiffer ground and a more elastic ground, a certain tendency of double jumps starts to appear, as is visible in the middle curve of FIG. 5. Every other peak of this curve has an increased height at the same time as the peaks between these peaks have reduced heights. In the top curve the signal has a periodicity coinciding with the periodicity of the excitation, but in the middle curve of FIG. 5 instead the periodicity has a frequency or periodicity which is half the frequency of the excitation. The oscillatory state, as is illustrated by the middle curve, can still be considered as stabile.

When the excitation increases further or the material is still stiffer, the tendencies of the middle curve of FIG. 5 are reinforced and a state having distinct pronounced double jumps appears. Every other peak in the lower curve of FIG. 5 increases so that it will have an amplitude of the magnitude of order of the double amplitude compared to the case for a low excitation. Every other peak here vanishes almost completely depending on the fact that the excitation here makes a stroke when the roller has left the ground, i.e. the excitation has an excitation period in the air between the blows or jolts against the ground. The proportion of frequency components having half the frequency will in this case be very high. The dominating excitation in fact takes place having half the original frequency of the original excitation frequency. It will in turn result in setting the frame of the roller machine (such as 10 in FIG. 4) in a strong oscillation movement. The ground is thus subjected to only half the number of blows but instead to approximately the double force amplitude. The compacting effect, however, for this case with very hard blows is ordinarily deteriorated since the ground is subjected to a significant redisintegration of its earlier compacted state. A further negative aspect for this excitation case is that the distances of the individual blows or jolts against the ground simultaneously will be double as high for a given rolling velocity of the roller drum.

Naturally it is desirable that excitation of the oscillation movement of the roller is made as strong as possible in order that the compacting and compressing effect of the roller will be as large and as rapid as possible. Therefore a control condition of the excitation is chosen principally as corresponding to the middle curve of FIG. 5. The excitation will thus be so large that the resulting roller oscillation will have a definite proportion of harmonic components having a frequency which is half the excitation frequency. A typical value of this proportion of the oscillation having half the frequency can be 5%. In this way still, a stabile travel of the roller machine is obtained and also a too instable travel of the roller machine is avoided. To obtain such an operational method a suitable signal processing is required, of curves of the type as illustrated in FIG. 5. An electric signal is obtained, such as has been described above, from the sensor 7 and therefrom parameters are produced in the block 51 in FIG. 1, which in turn are used for the control of parameters influencing the oscillating movement, the size of the oscillatory excitation.

Figure 6:
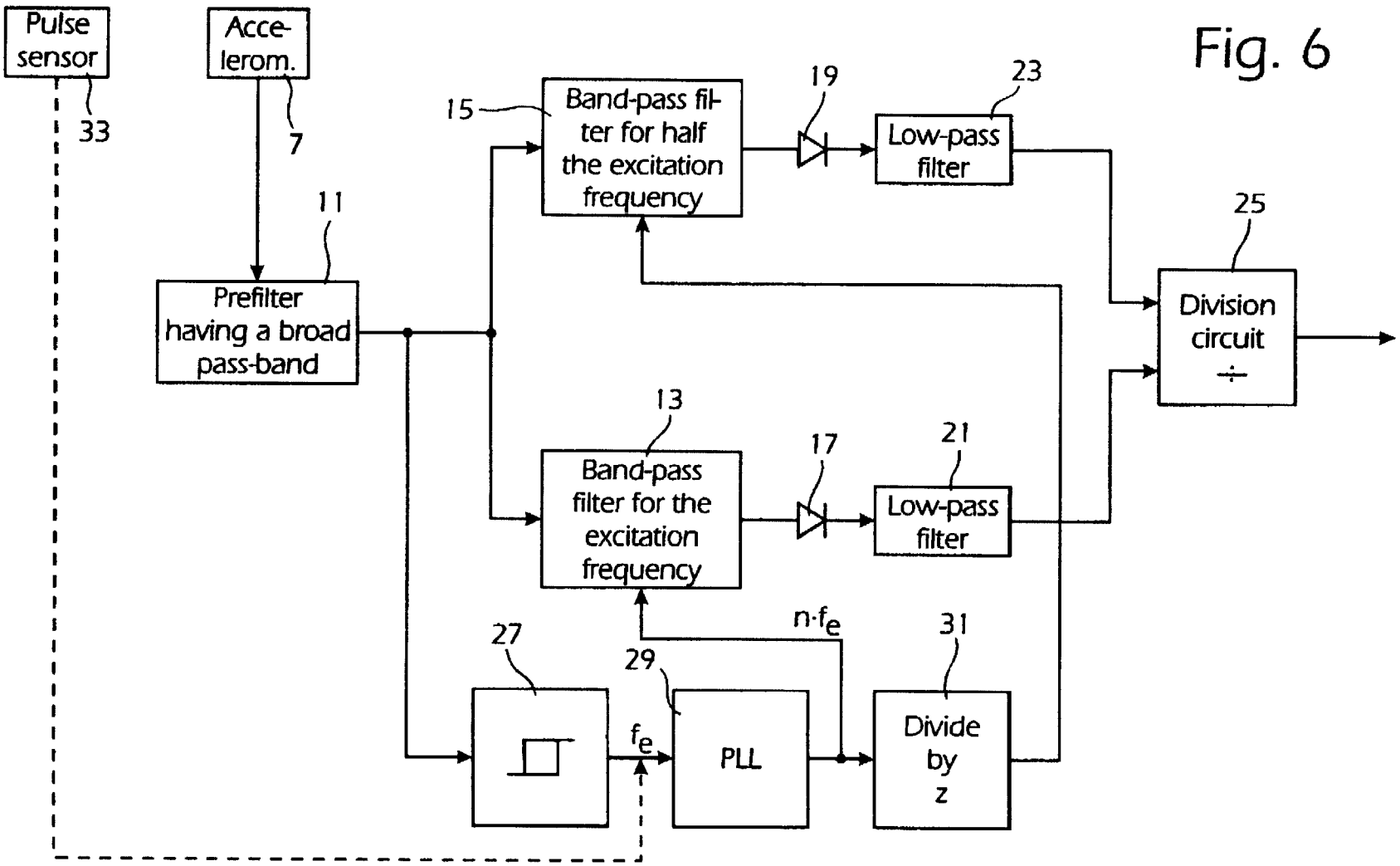
FIG. 6 shows a block diagram of an analogue production of a control signal.
Figure 7:
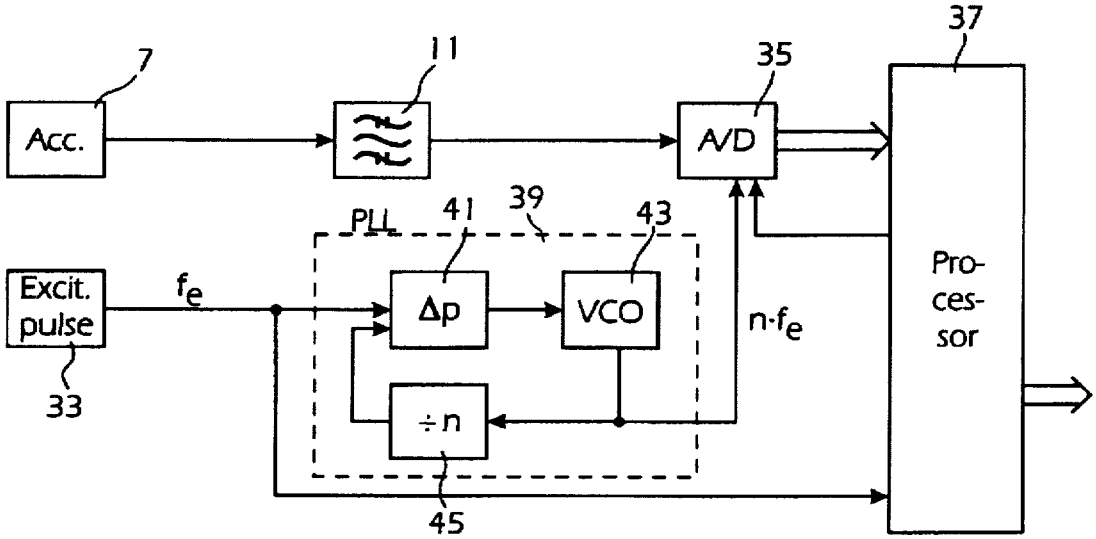
FIG. 7 shows a block diagram of a digital production of a control signal.

In FIG. 6 the method is illustrated in block diagram shape by which an analog signal processing can be designed to produce a signal used in the control rule of the logic circuits 53 in FIG. 1 to control a roller machine in a suitable way. From the accelerometer 7 electric signals are produced, which are pre-filtered in the filter 11 for removal of the very highest and very lowest frequencies. After this filtering operation electric signals are obtained having a curve shape of the kind as illustrated in FIG. 5. These signals are then fed to band-pass filters 13 and 15 for a filtering to produce the desired harmonic components. Thus the first band-pass filter 13 has a small pass-band centered around the excitation frequency $f_e$, with which the oscillation movement of the roller is driven. The second band-pass filter 15 has also a narrow pass-band but it is instead centered around half the excitation frequency, i.e. around $f_e/2$. After this filtering, from the band-pass filters 13 and 15 principally clean sinus oscillations are obtained which are then rectified in rectifying circuits 17 and 19 respectively. From the rectified signal its DC component is extracted in low-pass filters 21 and 23 respectively.

The DC signals obtained in this way which will then represent the amplitudes of the sinus oscillations as filtered, are divided by each other in a divisional circuit 25. It produces at its output terminal a signal representing the ratio of the amplitudes of the oscillation movement, i.e. for half the excitation frequency and for this frequency. The output signal of the division circuit 25 is fed to a controlling device in the shape of the control circuits 53, the drive circuits 55 and the actuating devices 57, see FIG. 1.

In the case where the excitation frequency is variable, the band-pass filters 13 and 15 must be implemented as filters having controllable frequencies. These frequencies can then be extracted from the pre-filtered signal itself, which in this case can be fed to a pulse-shaping circuit 27, after which an extraction of the base frequency of the output signal of the circuit 27 is made and a locking to a definite phase position such as a zero pass or position is made in the phase-lock circuit 29. The phase-lock circuit 29 can further be constructed in such a way that it on its output terminal produces a pulse train having a frequency $n \cdot f_e$ which is proportional to and e.g. is an even multiple of the excitation frequency. This signal is delivered to the band-pass filter 13, and for the control of the second band-pass filter in a divisional circuit a signal is generated having a frequency $n \cdot f_e/2$ corresponding to half this frequency. The value of the proportionality factor n depends on data of the controllable filters and can be of the magnitude of order 100.

As an alternative to the extraction of the excitation frequency directly from the pro-filtered signal, a pulse shaper 33 can, as has been indicated with reference to FIG. 1, be used which in some way senses the base frequency $f_e$ of the excitation. This signal can then directly be delivered to the phase-lock circuit 29 and then the pulse shaping unit 29 is eliminated.

The corresponding signal processing as performed in a digital way is illustrated in the block diagram of FIG. 6. The signal from the accelerometer 7, which is pre-filtered by the filter 11, is fed to an A/D-converter 35. The A/D-converter is controlled by means of a suitable pulse signal which is obtained from a pulse signal representing the frequency of the excitation and in this case is shown as obtained from a pulse sensor 33, e.g. located to directly sense the rotation of the eccentric body. Advantageously thus the pulse sensor can be arranged on the bearing plate 9 to sense each passage of some mechanical unevenness or some electric or magnetic inhomogeneity of the shaft of the eccentric. The signal of the accelerometer must be sampled by the A/D-convertor 35 during a time period corresponding to two full turns of the rotation of the eccentric body, i.e. two periods of the excitation. The sampling frequency is in an advantageous way selected as a natural number multiplied by the excitation frequency where the natural number advantageously can be a power of 2.

The digital signal obtained from the A/D-converter 35 is delivered to a signal processor 37 which performs a mathematic calculation of the Fourier-transform of the signal. Then the corresponding signals are obtained, i.e. the size of the DC-component, the amplitudes of the harmonic components having frequencies corresponding to half the excitation frequency, equal to the excitation frequency, corresponding to three times half the excitation frequency, etc. In particular, here the amplitudes are obtained for the harmonic components having frequencies corresponding to half the excitation frequency and to the excitation frequency and they are divided by each other to generate an output signal of the processor which is used in the control of the roller machine.

For obtaining suitable pulses for the control of the sampling in the A/D-converter 35 the signal from the pulse sensor 33 can as above be fed to a phase-lock circuit 39. In the phase-lock circuit 49 the signal representing the excitation frequency is fed to a phase detector 41. The output signal of the phase detector 41 is delivered to voltage control oscillator 43, the output signal of which is fed back to the phase detector 41 through a frequency-dividing circuit 45 producing pulses with a frequency corresponding to the oscillation frequency from the oscillator 43 divided by a natural number n and thus delivers its pulse signal back to the phase detector 41. The voltage controlled oscillator 43 will then produce an output signal of the pulse type having the desired frequency $n \cdot f_e$. The output signal of the oscillator will then also have a definite phase position in relation to the signal from the pulse sensor and then in relation to the signal representing the oscillation movement of the roller, which signal, however, the processor not necessarily has to use. The signal of the oscillator 43 is fed to the A/D-converter 35 for control of the sampling operation thereof.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method for controlling a body for compacting material comprising the steps of:

exciting the body to give the body an oscillation movement, the excitation being periodic and having a frequency;

sensing said oscillation movement; and controlling the exciting step, so that the resulting oscillating frequency of the vibrating body contains a predetermined proportion of a harmonic oscillation having a frequency corresponding to half the frequency with which the body is excited, thereby avoiding undesired oscillation movement.

2. The method according to claim 1, wherein the control step includes considering only the resulting oscillation movement in a plane which deviates from a vertical position by at most 30°.

3. The method according to claim 1, wherein the exciting step includes exciting the body at different excitation degrees resulting in substantially different amplitudes in the oscillation movement.

4. The method according to claim 1, wherein the exciting step, includes exciting the body at different excitation degrees resulting in substantially different frequencies in the oscillation movement.

5. The method according to claim 1, further comprising measuring the oscillation movement of the vibrating body using a sensor in a direction which deviates from the vertical direction by at most 30°.

6. The method according to claim 5, wherein the measuring step includes harmonically analyzing measured values as a function of the time to determine the amplitude of both a principal oscillation having half the excitation frequency, and the excitation oscillation having the excitation frequency, and comparing these amplitudes for use in the controlling step, so that the amplitude of the oscillation having half the excitation frequency always corresponds to a predetermined proportion of the amplitude of the oscillation having the excitation frequency.

7. The method according to claim 1, further comprising measuring the oscillation movement of the vibrating body by means of an accelerometer.

8. The method according to claim 7, wherein the measuring step includes harmonically analyzing measured values as a function of the time to determine the amplitude of both a principal oscillation having half the excitation frequency, and the excitation oscillation having the excitation frequency, and comparing these amplitudes for use in the controlling step, so that the amplitude of the oscillation having half the excitation frequency always corresponds to a predetermined proportion of the amplitude of the oscillation having the excitation frequency.

9. The method according to claim 1, wherein the exciting step includes moving a weight attached to the body.

10. The method according to claim 9, wherein the controlling step includes activating actuating devices to vary movement of the weight.

11. A device for control of a body for compacting a material located underneath the body, the body being arranged to be excited by excitation means to give the body an oscillation movement, the excitation being periodic and having a frequency, comprising a controller adjusting the excitation means in accordance with the oscillation movement so that the resulting oscillating movement of the vibrating body contains a predetermined proportion of a harmonic oscillation having a frequency corresponding to half the frequency with which the vibrating body is excited, thereby avoiding undesired oscillation movement.

12. The device according to claim 11 wherein the controller is arranged to only consider the resulting oscillation movement of the body in a plane which deviates from the vertical position by at most 30°.

13. The device according to claim 11, further comprising a sensor for measuring the oscillation movement of the vibrating body.

14. The device according to claim 13, wherein further comprising means for mounting the sensor for a determination of the acceleration of the body in a direction which deviates from a vertical direction by at most 30°.

15. The device according to claim 13, further comprising means for attaching the sensor to the body or to a part in which the body is rotatably mounted.

16. The device according to claim 13, wherein the sensor is an accelerometer.

17. The device according to claim 13, further comprising calculation means for analysing harmonically the registered values of the oscillation movement as a function of time in order to determine the amplitude of both an oscillation having half the excitation frequency and the oscillation having the excitation frequency, the controller being arranged to compare these amplitudes in the control and the adjustment of the excitation means, so that the amplitude of the oscillation having half the excitation frequency always corresponds to a predetermined proportion of the amplitude of the oscillation having the excitation frequency.

18. The device according to claim 11, wherein the body is excited by moving a weight attached thereto and the controller varies movement of the weight.

19. The device according to claim 18, wherein the controller varies at least one of rotational velocity of the weight, amplitude of the weight and the distance of the weight from its rotational axis.

* * * * *